US006098233A

United States Patent [19]

Chen

[11] Patent Number: 6,098,233

[45] Date of Patent: Aug. 8, 2000

[54] BATH BRUSH WITH MASSAGE MEANS

[75] Inventor: Kuo-Chin Chen, Taipei, Taiwan

[73] Assignee: Confirm Personal Care Industrial Corporation, Taoyuan Hsien, Taiwan

[21] Appl. No.: 09/326,486

[22] Filed: Jun. 4, 1999

[51] Int. Cl.[7] ..... A47K 7/02

[52] U.S. Cl. ..... 15/110; 601/137; 601/138

[58] Field of Search ..... 15/110; 132/120; 601/17, 109, 111, 114, 135, 137, 138

[56] References Cited

U.S. PATENT DOCUMENTS

| | | | |
|---|---|---|---|
| 1,022,920 | 4/1912 | Anderson | 15/110 |
| 1,092,710 | 4/1914 | Hartmann | 15/110 |
| 1,251,250 | 12/1917 | Libby | 15/110 |
| 1,588,785 | 6/1926 | Van Sant | 15/110 |
| 1,598,224 | 8/1926 | Van Sant | 15/110 X |
| 1,870,756 | 8/1932 | Seykora | 15/110 |
| 4,277,862 | 7/1981 | Weideman | 15/110 |
| 5,211,494 | 5/1993 | Baijnath | 15/110 X |

FOREIGN PATENT DOCUMENTS

| | | | |
|---|---|---|---|
| 388246 | 2/1933 | United Kingdom | 15/110 |

*Primary Examiner*—Mark Spisich
*Attorney, Agent, or Firm*—Pro-Techtor International Services

[57] ABSTRACT

A bath brush including a seat and brush hair holder fixedly connected to an upper surface of the seat. The seat is provided at the upper surface with a plurality of upward extended massage bars. The brush hair holder has a plurality of tufted hairs planted on an upper surface thereof. Positions on the brush hair holder corresponding to the massage bars on the seat are cut out to form through holes for the massage bars to project therefrom and locate among the tufted hairs. The massage bars have tops lower than that of the tufted hairs on the brush hair holder, whereby when the bath brush is used to brush and clean a user's skin, the tufted hairs are elastically bent to bring the massage bars into contact with the skin and gently massage the skin.

7 Claims, 4 Drawing Sheets

BATH BRUSH WITH MASSAGE MEANS

BACKGROUND OF THE INVENTION

The present invention relates to a bath brush, and more particularly to a bath brush being provided with means to enable the bath brush to effectively massage a user's skin while cleansing the skin.

Most of the commercially available bath brushes have a substantially rectangular configuration and a base having tufted soft hairs densely planted over an upper surface thereof. Such conventional bath brushes can be used only to brush and clean skin without other additional functions. Nor do these bath brushes create comfortable feeling when the brush hairs contact with the skin.

To give the conventional bath brushes increased values, other means may be incorporated in the bath brushes to provide additional functions, so that the bath brushes are more practical and more comfortable for use.

SUMMARY OF THE INVENTION

A primary object of the present invention is to provide a bath brush with massage means, so that the bath brush may brush and cleanse a user's skin while gently and comfortably massage the skin.

To achieve the above and other objects, the present invention provides a bath brush having a seat and a brush hair holder fixedly connected to an upper surface of the seat. The seat is provided at the upper surface with a plurality of upward extended massage bars. The brush hair holder has a plurality of tufted hairs planted on an upper surface thereof. Positions on the brush hair holder corresponding to the massage bars on the seat are cut out to form through holes for the massage bars to project therefrom and locate among the tufted hairs. The massage bars have tops lower than that of the tufted hairs on the brush hair holder, whereby when the bath brush is used to brush and clean a user's skin, the tufted hairs are elastically bent to bring the massage bars into contact with the skin and gently massage the skin.

BRIEF DESCRIPTION OF THE DRAWINGS

The structural features of the present invention can be best understood by referring to the following detailed description of the preferred embodiments and the accompanying drawings, wherein.

DETAILED DESCRIPTION OF THE PREFERRED EMBODIMENTS

Figure 1:
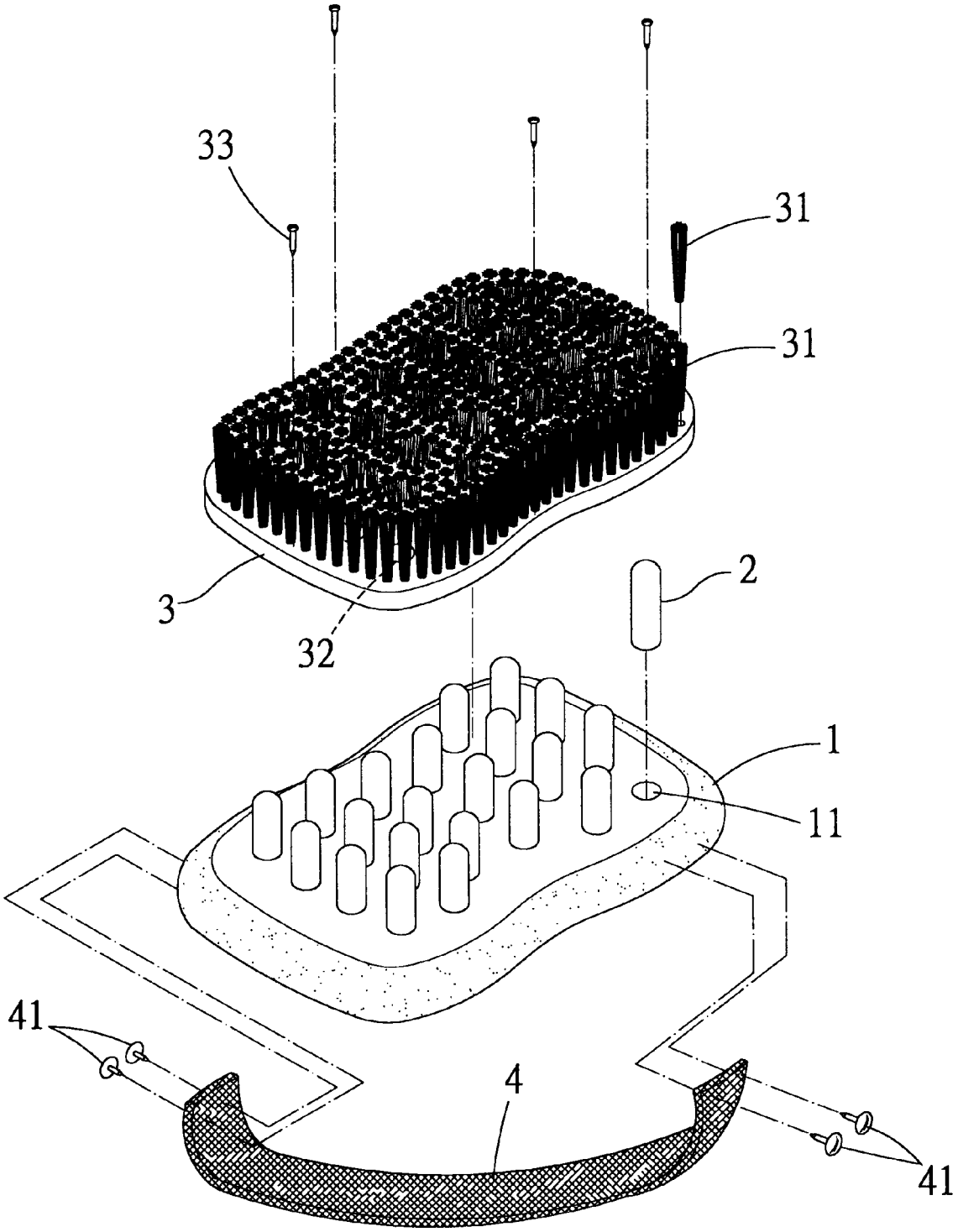
FIG. 1 is an exploded perspective of a bath brush according to the present invention.
Figure 2:
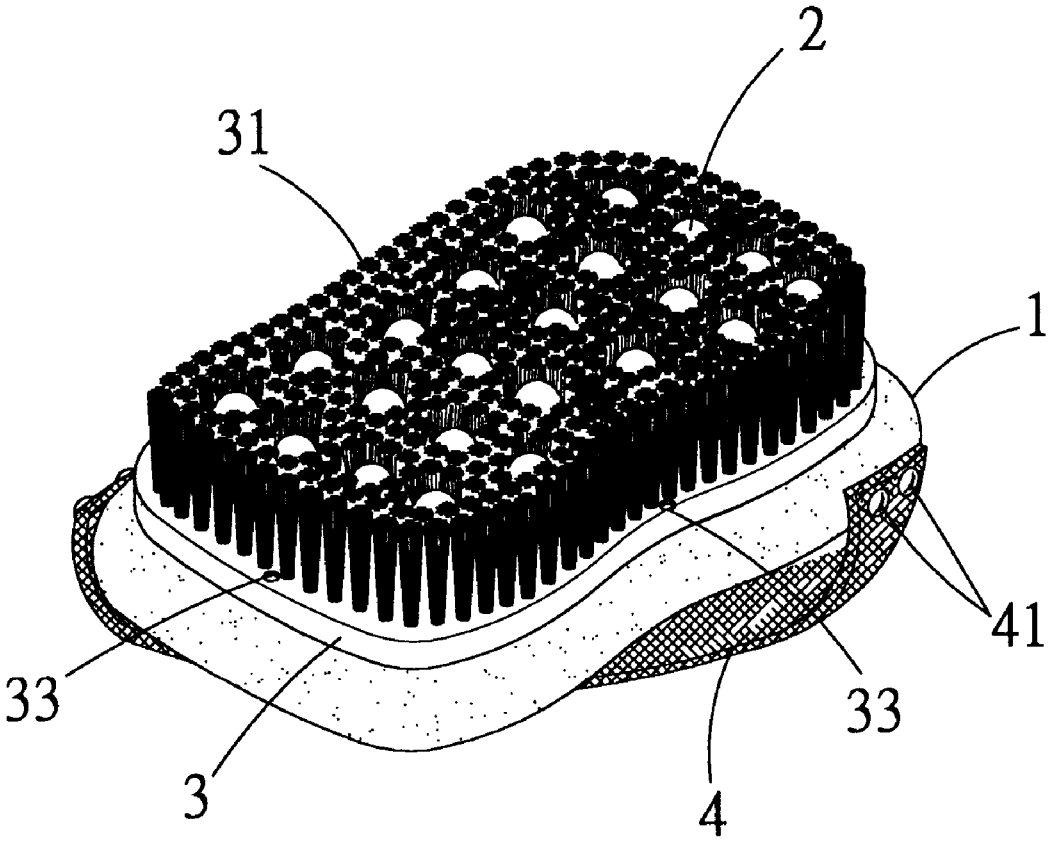
FIG. 2 is an assembled perspective of the bath brush of the present invention.

Please refer to FIGS. 1 and 2 that are exploded and assembled perspective views, respectively, of a bath brush according to the present invention. As shown, the bath brush mainly includes a seat 1 and a brush hair holder 3.

The seat 1 is provided at an upper surface with a plurality of recess holes 11 into each of which a massage means 2 is inserted and fixed by fastening means, such as glue. The massage means 2 may be a round bar having a substantially semi-spherical top. A belt 4 is fixed at two ends to two lateral sides of the seat 1 by means of suitable fastening means 41, such as nails, so that the belt 4 loosely extends across a lower surface of the seat 1 to define a suitable space between the belt 4 and the lower surface of the seat 1 for a user's hand to extend therethrough and hold the bath brush.

The brush hair holder 3 is connected to the upper surface of the seat 1 by fastening means 33, such as nails or glue. A plurality of tufted hairs 31 are planted on an upper surface of the brush hair holder 3. Positions on the brush hair holder 3 corresponding to the massage means 2 on the seat 1 are cut out to form through holes for the massage means 2 to upward extend therethrough.

Figure 3:
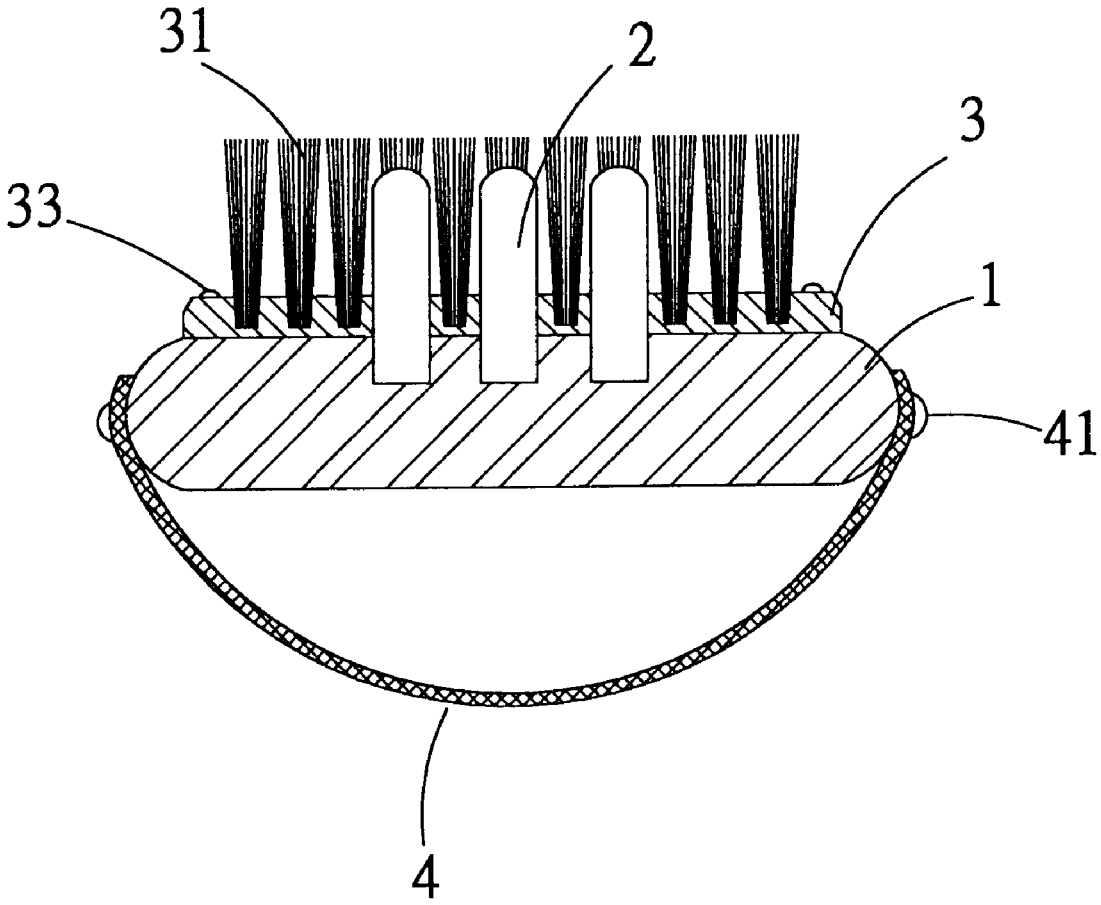
FIG. 3 is a side sectional view of the bath brush of FIG. 2.

Please refer to FIG. 3 that is a side sectional view of the bath brush of the present invention. As shown, the massage means 2 have tops that are slightly lower than tops of the tufted hairs 31 on the brush hair holder 3. That is, there is a predetermined distance between the tops of the hairs 31 and of the massage means 2 and the massage means 2 are lower than the tufted hairs 31.

Figure 4:
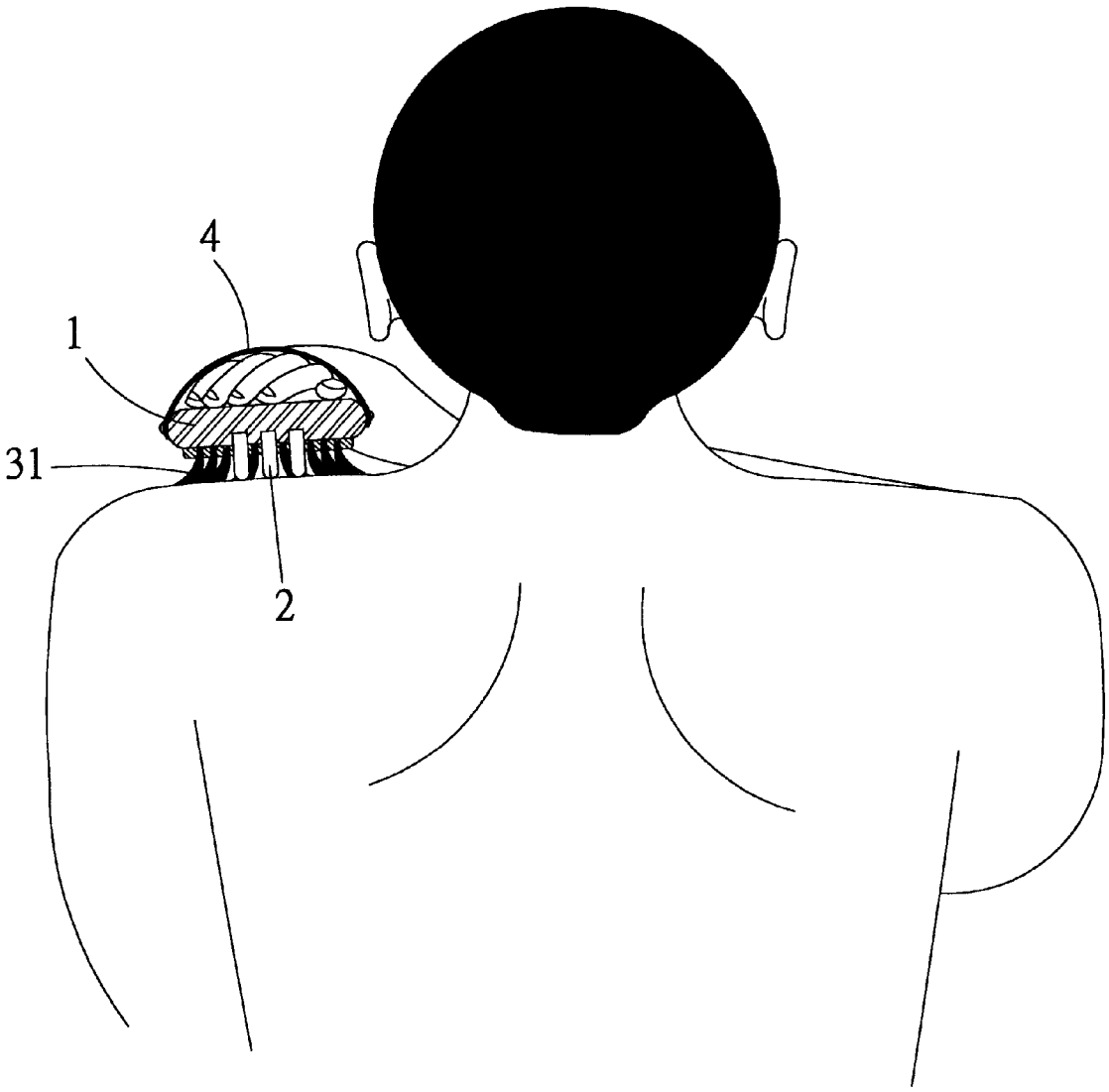
FIG. 4 shows the bath brush of the present invention in use.

FIG. 4 illustrates the bath brush of the present invention in use. To use the bath brush to brush and cleanse skin, a user may extend one hand through the space between the belt 4 and the lower surface of the seat 1 and hold two lateral sides of the bath brush. The user may apply a minor force on the bath brush while moving the bath brush around the skin, so that the tufted hairs 31 are slightly and elastically bent, causing the tops of the massage means 2 to contact with and massage the skin when the bath brush is moved around on the skin. The semi-spherical tops of the massage means 2 provide comfortable contact of the massage means 2 with the skin.

With these arrangements, the bath brush of the present invention has novel structure and good massage effect and is therefore more practical and comfortable for use.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A bath brush comprising a seat and a brush hair holder;

said seat being provided at an upper surface with a plurality of fixedly connected and upward extended massage means;

said brush hair holder being fixedly connected to the upper surface of said seat and having a plurality of tufted hairs planted on an upper surface thereof for brushing and cleansing a user's skin, positions on the upper surface of said brush hair holder corresponding to said massage means on said seat being cut out to form through holes, allowing said massage means to upward project from said through holes on said brush hair holder; and said massage means projected from said brush hair holder having tops lower than that of said tufted hairs, whereby when said bath brush is pressed against and moved around a user's skin to brush and clean the skin, said tufted hairs are elastically bent to bring said massage means into contact with the user's skin and gently massage the skin.

2. A bath brush as claimed in claim 1, wherein said seat is provided at the upper surface with a plurality of recess holes for said massage means to insert there into and fix thereto by suitable fastening means.

3. A bath brush as claimed in claim 2, wherein said fastening means is glue.

4. A bath brush as claimed in claim 1, wherein said massage means are in the form of round bars and have semi-spherical tops.

5. A bath brush as claimed in claim 2, wherein said massage means are in the form of round bars and have semi-spherical tops.

6. A bath brush as claimed in claim 3, wherein said massage means are in the form of round bars and have semi-spherical tops.

7. A bath brush as claimed in claim 1, further comprising a belt extending across a lower surface of said seat with two ends fixed to two lateral sides of said seat by fastening means, so that a space is defined between said belt and said seat for a user's hand to extend therethrough and hold said bath brush.

* * * * *